US010046580B2

(12) United States Patent
Elferink et al.

(10) Patent No.: US 10,046,580 B2
(45) Date of Patent: Aug. 14, 2018

(54) MOUNTING STRUCTURE FOR A PLURALITY OF PRINT HEAD UNITS

(71) Applicant: OCE-TECHNOLOGIES B.V., Venlo (NL)

(72) Inventors: Maarten J. H. Elferink, Venlo (NL); Chad A. Koehn, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/262,666

(22) Filed: Sep. 12, 2016

(65) Prior Publication Data

US 2016/0375707 A1 Dec. 29, 2016

Related U.S. Application Data

(63) Continuation of application No. PCT/EP2015/055883, filed on Mar. 20, 2015.

(60) Provisional application No. 61/970,558, filed on Mar. 26, 2014.

(30) Foreign Application Priority Data

Apr. 23, 2014 (EP) ..... 14165555

(51) Int. Cl.
*B41J 2/155* (2006.01)
*B41J 29/02* (2006.01)
*B41J 25/00* (2006.01)

(52) U.S. Cl.
CPC ..... *B41J 29/02* (2013.01); *B41J 2/155* (2013.01); *B41J 25/001* (2013.01)

(58) Field of Classification Search
CPC .... B41J 2/155; B41J 2202/20; B41J 2/16585; B41J 2202/19; B41J 2/1752; B41J 29/02; B41J 2002/14362; B41J 2002/14419; B41J 2202/21; B41J 25/003; B41J 25/00; B41J 25/001
USPC ..... 347/13, 40, 42, 49
See application file for complete search history.

(56) References Cited

U.S. PATENT DOCUMENTS

| | | | | |
|---|---|---|---|---|
| 8,425,007 | B2 * | 4/2013 | Essen | B41J 2/155 347/40 |
| 2002/0191049 | A1 * | 12/2002 | Silverbrook | B41J 2/14024 347/49 |
| 2006/0077225 | A1 | 4/2006 | Song et al. | |
| 2014/0160201 | A1 | 6/2014 | Choi | |

FOREIGN PATENT DOCUMENTS

| | | | |
|---|---|---|---|
| EP | 1 676 711 | B1 | 10/2007 |
| WO | WO 01/64441 | A1 | 9/2001 |
| WO | WO 2006/116575 | A2 | 11/2006 |
| WO | WO 2013/133475 | A1 | 9/2013 |

* cited by examiner

*Primary Examiner* — Jannelle M Lebron
(74) *Attorney, Agent, or Firm* — Birch, Stewart, Kolasch & Birch, LLP

(57) ABSTRACT

A mounting structure for a plurality of print head units includes a frame; a rigid support mounted on the frame, the support having a plurality of mounting sites each of which is adapted to hold an individual print head unit; and an adjusting system for positional adjustment of the print head units relative to the frame. Each mounting site has at least one adjusting mechanism for individually adjusting, in at least one degree of freedom, a position of the print head unit that is held in that mounting site.

16 Claims, 6 Drawing Sheets

MOUNTING STRUCTURE FOR A PLURALITY OF PRINT HEAD UNITS

CROSS REFERENCE TO RELATED APPLICATIONS

This application is a Continuation of PCT International Application No. PCT/EP2015/055883, filed on Mar. 20, 2015, which claims priority under 35 U.S.C. 119(e) to U.S. Provisional Application No. 61/970,558, filed on Mar. 26, 2014 and under 35 U.S.C. 119(a) to patent application Ser. No. 14/165,555.5, filed in Europe on Apr. 23, 2014, all of which are hereby expressly incorporated by reference into the present application.

The invention relates to a mounting structure for holding a plurality of print head units.

A printer, e.g. an ink jet printer, frequently comprises a plurality of print head units each of which has a plurality of printing elements (nozzles) the positions of which must be carefully adjusted relative to one another in order to assure a high print quality.

EP 1 676 711 B1 discloses a mounting structure of the type indicated above, wherein the individual print head units are rigidly held in the mounting sites of a common support, and a flexure-based adjusting system is arranged for adjusting the entire support structure with the print head units held therein relative to the frame.

In other known printers, a dense configuration of a large number of print heads is provided. For example, a staggered array of print heads may be provided over the width of a recording medium, forming a page-wide array. Then, using four colours (e.g. CMYK), the number of print heads may become large. Replacing or servicing one of such print heads is difficult and a lot of effort is needed and a lot of time is consumed merely for demounting and mounting.

It is an object of the invention to provide a mounting structure that permits easier demounting and mounting.

The object is achieved in a mounting structure according to claim 1.

The mounting structure according to the invention further permits to adjust the print head units not only relative to the rigid support but also relative to one another. Consequently, it is possible to correct manufacturing tolerances of the individual print head units as well as manufacturing tolerances of the common support. This has the further advantage that the manufacture of the print head units and the support may be cheaper because larger tolerances can be allowed.

The invention facilitates a replacement of an individual print head unit in a printer, because, when the new print head unit has been inserted, this individual print head unit can be adjusted relative to all the other units. In order to replace or service a print head, the rigid support and any print head mounted thereon can be easily demounted and taken away from the printer. Then, the print head may be replaced by another print head and, if appropriate, be positioned relative to the other print heads mounted on the rigid support. Then, the rigid support including the mounted print heads can be mounted on the printer again. Of course, it is also possible to just mount the other print head, then mount the rigid support on the printer and only then position the other print head relative to the other print heads.

Useful optional features of the invention are indicated in the dependent claims.

In an embodiment, the mounting structure according to the present invention, the frame and the rigid support are provided with mating positioning and mounting elements for detachably mounting the rigid support on the frame. The positioning and mounting elements ensure a proper mounting and an accurate positioning of the rigid support relative to the frame and thus of the print head units relative to the frame. As a result, the rigid support and print head units may be demounted and mounted again and achieving a same accurate positioning of the print head units in the printer.

In a particular embodiment, the mating positioning and mounting elements comprise at least one spherical positioning bulge and respective recess for receiving said bulge. It is known that spherical elements to be positioned in a recess allow suitable and accurate positioning without an over-constrained mechanical coupling.

In a more particular embodiment, the three recesses comprise a support patch and a V-shaped positioning groove. Using such a support patch and V-shaped groove, thermal expansion is enabled.

In an embodiment, the adjustment mechanisms in the individual mounting sites comprise flexure plates each of which is adapted to hold a mounting portion of the associated print head rigidly in a first direction but is flexible in at least one of the two other directions that are orthogonal to said first direction.

The print head units may each have a large number of printing elements or nozzles that form an elongated array that extends in a given direction, and the nozzle arrays of the individual print head units may be aligned in that direction. Then, the mounting sites are preferably disposed such that the individual print head units are separated from one another by gaps which enable independent adjustment movements of the individual units. The mounting sites of the rigid support may be disposed in two rows and staggered such that the print head units held in the mounting sites of one row fill the gaps between the print head units held in the mounting sites of the other row.

In an embodiment, each mounting site has at least two independent adjusting mechanisms, one for a linear adjustment of the print head unit in the direction of the row of print head units, and one for a yaw adjustment of the print head unit about an axis that is normal to a plane defined by the arrays of printing elements.

The two adjustment mechanisms and additional holders for holding the print head unit in the mounting site may be configured such that they define a fixed position of the print head unit relative to the support in all four remaining degrees of freedom.

It may be preferable that the adjustment mechanisms and holders of each mounting site are clamped to the common support. Then, when the mounting structure is assembled, a jig may be used for aligning the sub-assemblies comprising the adjustment mechanisms and the holders for the print head units relative to one another, and then the adjustment mechanisms and holders may be clamped to the support while being held in the jig, thereby to define the positions of the adjustment mechanisms and holders relative to the support while retaining the spatial relationships between the individual units.

In an embodiment, each mounting site comprises a carrier that is adjustable by means of the adjustment mechanisms and has reference surfaces that define the position of the print head unit relative to the carrier. Mechanical clamps may be used for detachably clamping each print head unit into the associated carrier.

An embodiment example will now be described in conjunction with the drawings, wherein.

Figure 1:
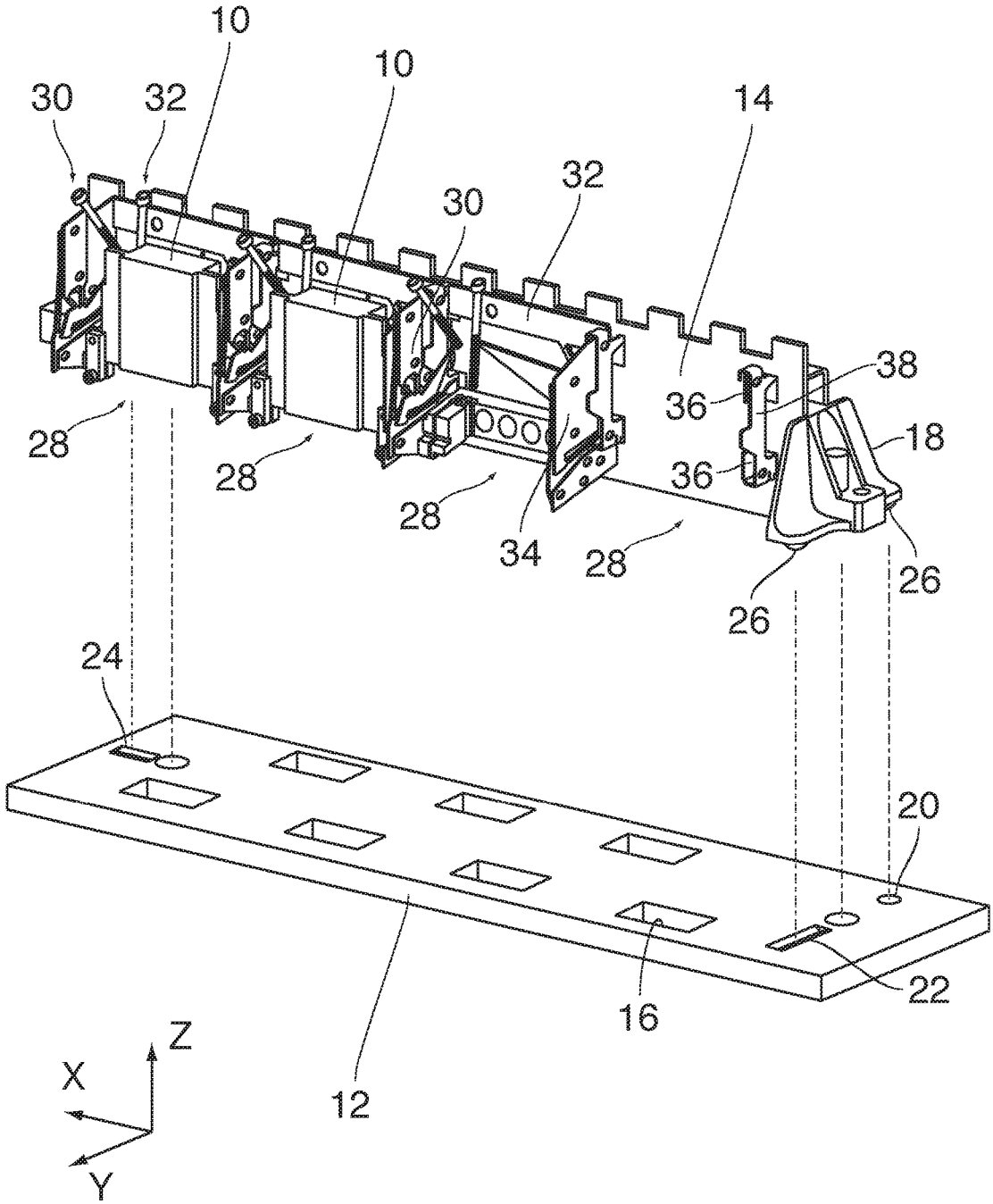
FIG. 1 is a simplified perspective view of essential parts of a mounting structure according to the invention.

As is shown in FIG. 1, a mounting structure for a plurality of ink jet print head units 10 (only two units have been shown here) comprises a plate-like frame 12 and a rigid support 14 that is adapted to be mounted on the frame 12 in a fixed position. The frame 12 has two rows of rectangular cut-outs 16 that are aligned in a direction X and are each adapted to accommodate a downwardly facing nozzle face of one of the print head units 10, which nozzle face defines a nozzle array that extends also in X-direction. The cut-outs 16 in the two rows are staggered such that the cut-outs of one row fill the gaps between the cut-outs of the other row. Thus, when print head units 10 are inserted in all cut-outs, it is possible to print a continuous line of pixels onto a recording medium (not shown) that is moved in a direction Y past the bottom side of the frame 12.

The support 14 is basically formed by a rigid plate that is oriented vertically (in the Y-Z-plane normal to the X-Y-plane of the frame 12). Mounting sockets 18 are formed on both ends of the support 14, so that the support can be fixed on the frame 12 with preloaded fastening screws (not shown) which will however permit a certain play in the X-Y-plane of the frame 12. A flat support patch 20 and a V-shaped positioning groove 22 that extends in X-direction are formed in the top surface of the frame 12 at one end thereof. A conical positioning pit 24 is formed in the top surface of the frame 12 at the other end thereof. The mounting sockets 18 of the support 14 form three spherical positioning bulges 26 (only two of which are visible) for engagement on the support patch 20 and into the positioning pit 24 and the positioning groove 22. In this way, as is known per-se, the support 14 is held in a well-defined but not overconstrained position relative to the frame 12, and thermal expansion of the support can be allowed for.

In this example, the support 14 has four mounting sites 28 for the print head units 10 on the side that is visible in FIG. 1, and three further mounting sites (not visible) for the print head units on the back side of the support. In the drawing, the rightmost mounting site 28 has been shown incomplete, and the adjacent mounting site has been shown empty, i.e. without print head unit.

As will be explained in greater detail below, each mounting site 28 comprises two adjusting mechanisms 30, 32 and a holder 34 for the print head unit 10. The support 14 has two rows of tabs 36 that have been cut out of the plate-like main part of the support and have been bent at right angles so as to project to the front side in FIG. 1. These tabs 36 delimit the mounting sites 28. Associated with each pair of tabs 36 is a bracket 38 that is folded-over in U-shape at both the top end and the bottom end so as to embrace the tabs 36. Arm portions of the brackets 38 extend through the cut-outs that have been left open by the tabs 36 and engage reference surfaces on the back side (not visible) of the support 14, so that each bracket 38 is held in a well-defined position relative to the support 14.

Each of the brackets 38 serves to attach a holder 34 of one mounting site 28 and the adjusting mechanism 30 of an adjacent mounting site to the support 14. To that end, the adjusting mechanism 30 engages the tabs 36 from one side, and the holder 34 engages the same tabs from the other side, and all these members are clamped together by means of clamping screws (not shown) that pass through the U-shaped ends of the bracket 38.

Figure 2:
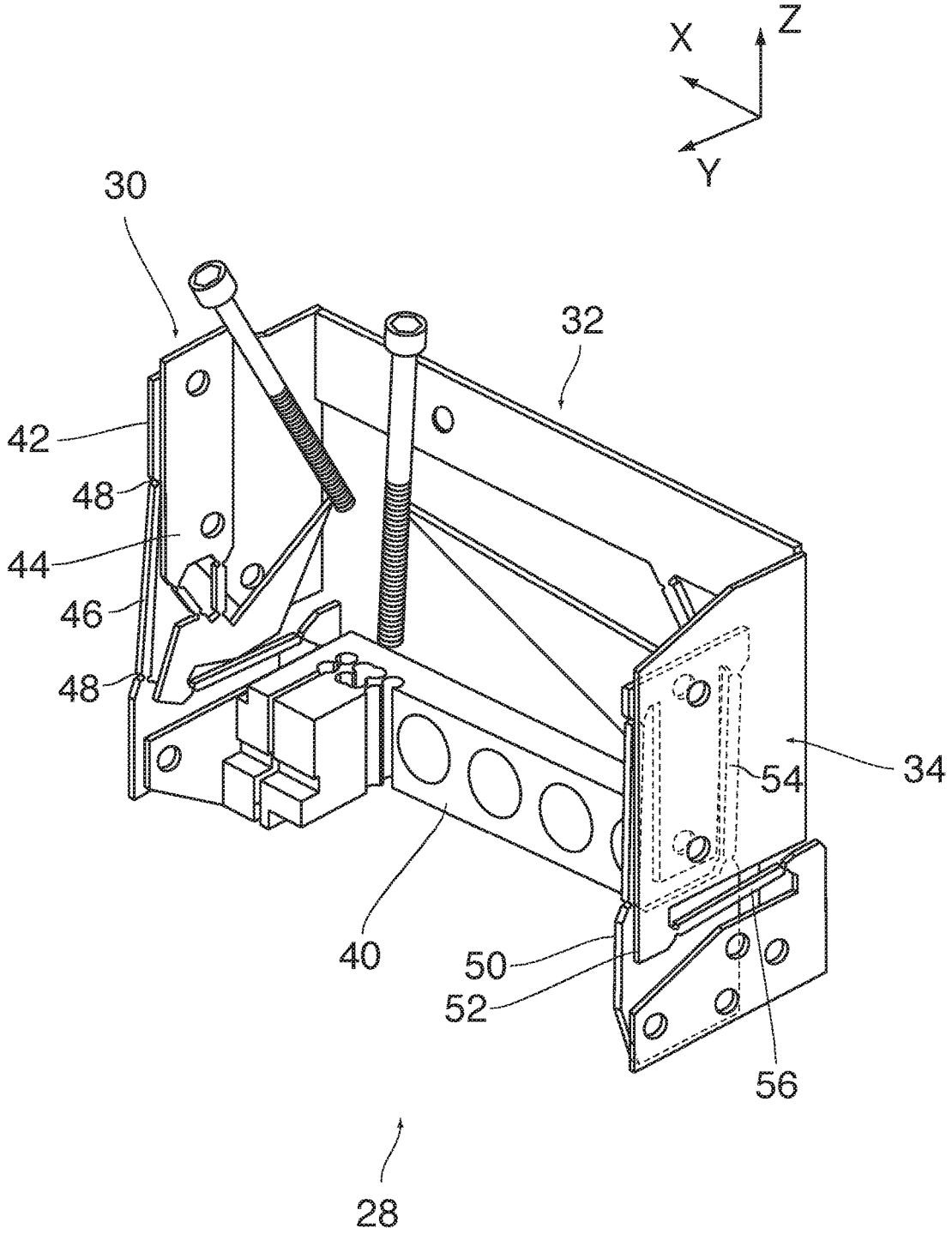
FIG. 2 is a perspective view of an individual mounting site with two adjusting mechanisms.

A single (empty) mounting site 28 has been shown in FIG. 2. A left side wall of the mounting site 28 is formed by the adjusting mechanism 30, and a rear wall is formed by the adjusting mechanism 32 that is attached to the support 14 (not shown in FIG. 2), e. g. by means of clamping bolts. A right side wall of the mounting site is formed by the holder 34.

A rigid carrier 40 for the print head unit 10 has a left end attached to the adjusting mechanism 30 and a right end attached to both the adjusting mechanism 32 and the holder 34. The adjusting mechanism 30 permits a yaw adjustment of the carrier 40 about the Z axis by moving the left end of the carrier 40 in Y-direction while the right end is fixed in Y-direction by the holder 34 which, together with the adjusting mechanism 32, a fictional pivot point. The adjusting mechanism 32 permits an adjustment of the X-position of the carrier 34 by moving the carrier 40 in a linear translational movement along the X-axis. The adjusting mechanism 30 and the holder 34 are each attached to the carrier 40 by means of at least two bolts so as to prevent a rotation of the carrier 40 about the X-axis and hold both ends of the carrier 40 in fixed positions in Z-direction, thereby preventing also a rotation about the Y-axis.

More precisely, the adjusting mechanism 30 comprises two parallel plates 42 and 44 that are made of sheet metal. The two plates have respective top parts that are attached to one another face to face and are held at the support 14 by the clamp 38 (FIG. 1). Respective bottom parts of the plates 42 and 44 are also attached together face to face and are further attached to the left end of the carrier 40. The top and bottom parts of the plate 42 are connected to one another via a link 46 and two flexible hinges 48 that are simply formed by thinned parts at the opposite ends of the link 46. Thanks to the link 46, the plate 42 allows for the adjustment movement of the left end of the carrier 40 in Y-direction and would also permit a rotation about the X-axis but prevents a movement in Z-direction. Conversely, the bottom part of the other plate 44 controls the movement of the left end of the carrier 40 in Y-direction, as determined by the adjusting mechanism 30, but is not constrained in Z-direction nor in a rotation about the X-axis.

Similarly, the holder 34 is formed by two plates 50, 52 that are disposed face to face and held by another one of the clamps 38 (FIG. 1). The plates 50, 52 are also made of sheet metal and have respective top and bottom parts that are firmly attached together, the bottom parts being further attached to the right end of the carrier 40. The top and bottom parts of the plate 52 are connected via vertical hinged links 54 (parallelogram linkage), so that this plate determines the Z-position of the right end of the carrier 40 and also constrains a rotation about the X-axis. The top and bottom parts of the other plate 52 are connected by a horizontal hinged link 56, so that the bottom part fixes the Y-position of the right end of the carrier 40 but is not constrained in Z-direction. Thanks to the links 54, 56, the bottom parts of both plates 50 and 52 are free to follow the pivotal movement of the carrier 40 about the Z-axis as caused by the adjusting mechanism 30, and they create a virtual pivot point.

Further, the plates 42, 44, 50 and 52 are free to bend in order to follow the translational movement of the carrier 40 in X-direction as controlled by the adjusting mechanism 32.

Figure 3:
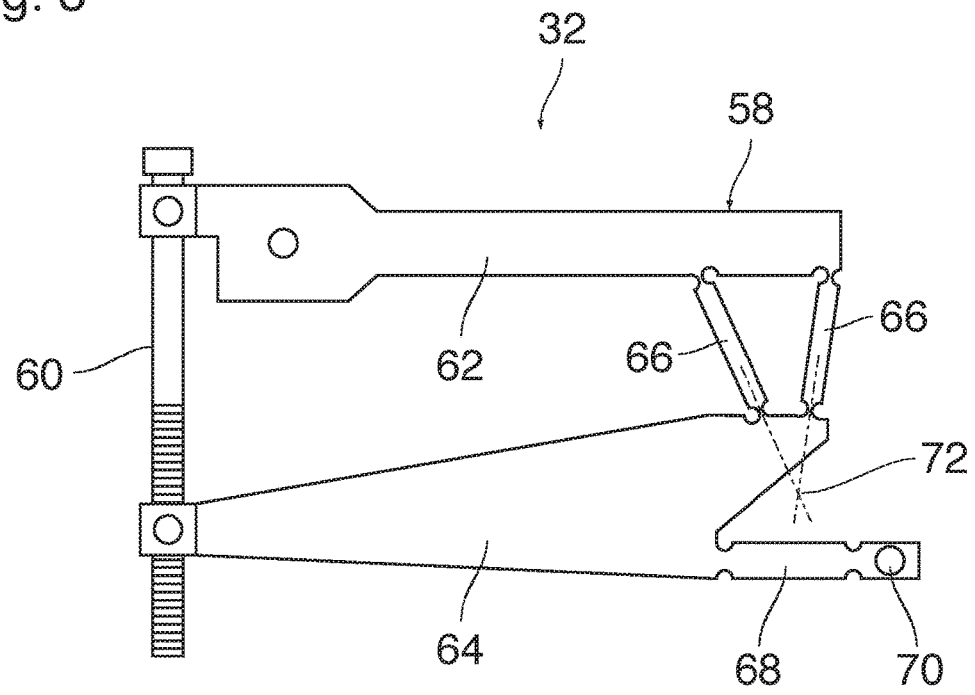
FIGS. 3 and 4 are diagrams illustrating the function of one of the two adjusting mechanisms shown in FIG. 2.

The adjusting mechanism 32 has been shown in greater detail in FIGS. 3 and 4, and the function of this mechanism will now be explained.

The adjusting mechanism 32 is basically constituted by a plate member 58 of punched or laser cut sheet metal, and a screw-and-spring-type linear-adjustor 60 of a known construction. The plate member 58 comprises a base 62 that is attached to the support 14 (FIG. 1), and a triangular lever 64 that is connected to the base 62 via two non-parallel hinged links 66. The ends of the base 62 and the lever 64 are connected by the adjustor 60. A third corner of the triangular lever 64, below the links 66, is connected via a horizontal hinged link 68 to a fastening tab 70 for the right end of the carrier 40 (FIG. 2).

Figure 4:
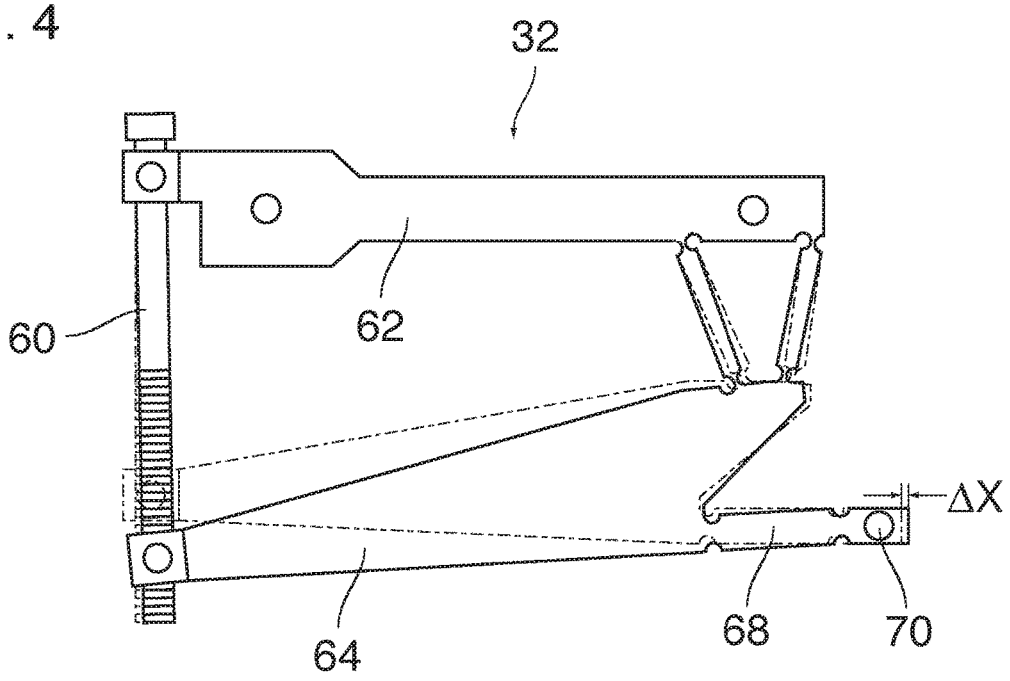

As is shown in FIG. 4, when the adjustor 60 is actuated to change the distance between the base 62 and the lever 64, the lever 64 tilts about a virtual pivot 72 (FIG. 3) that is defined by the section point between the linear extensions of the two links 66. As a result, the horizontal link 68 pushes the fastening tab 70 in X-direction so as to change the X-position of the carrier 40 by a certain amount ΔX. It will be noted that ΔX is small compared to the shift of the left end of the lever 64 that is controlled by means of the adjustor 60. This means that the adjusting mechanism 32 permits to control the X-position with very high accuracy. It will further be noted that the link 68 assures that the Z-position of the fastening tab 70 and the carrier 40 will not be changed by the adjusting mechanism 32.

Figure 5:
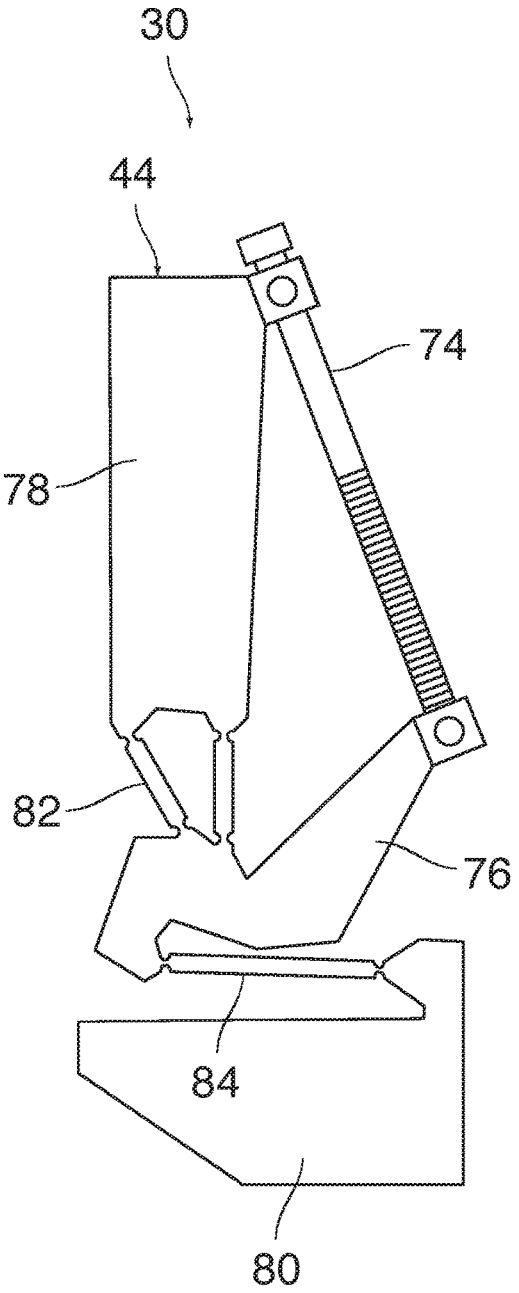
FIGS. 5 and 6 are diagrams illustrating the function of the second adjusting mechanism shown in FIG. 2.

The function principle of the other adjusting mechanism 30 will now be explained in conjunction with FIGS. 5 and 6 which show a detailed view of the plate 44 as well as another screw-and-spring-type linear adjustor 74.

The plate 44 forms a lever 76 that is arranged between the top part 78 and the bottom part 80 of this plate and is connected to the top part 78 via two non-parallel hinged links 82 and to the bottom part 80 via a horizontal hinged link 84. The adjustor 74 connects the top end of the top part 78 to the free end of the lever 76.

Figure 6:
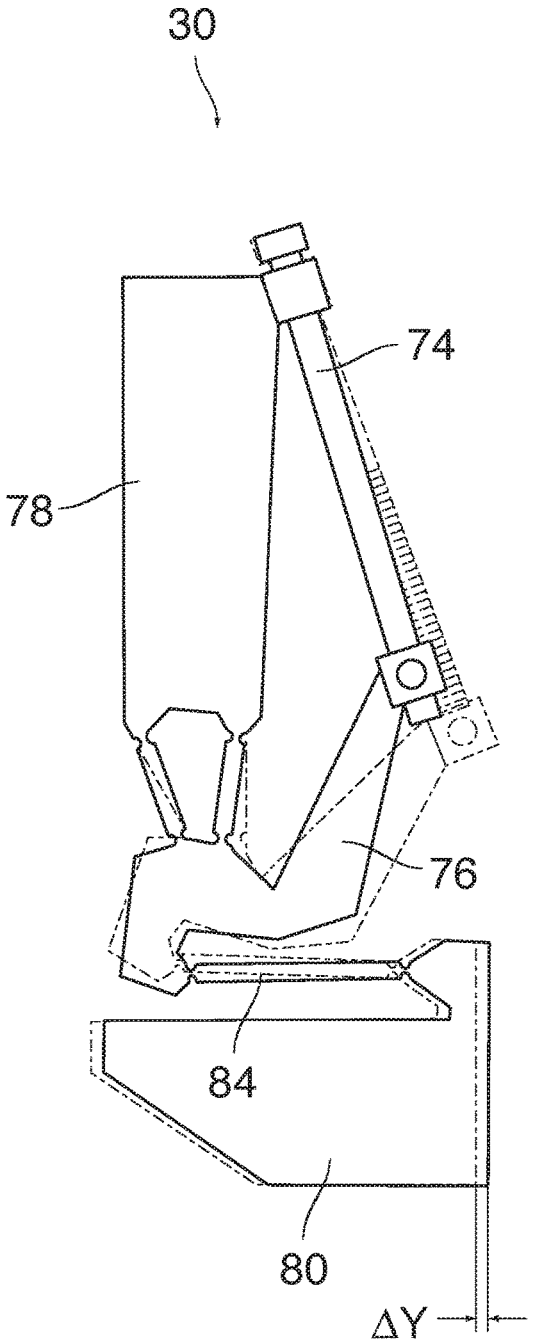

As is shown in FIG. 6, when the distance between the top end of the top part 78 and the free end of the lever 76 is changed by means of the adjustor 74, the lever 76 turns about a virtual pivot that is defined by the two links 82, and the bottom part 80 is drawn or pushed by the link 84 so as to move in Y-direction. In this way, the left end of the carrier 40 (FIG. 2) is moved by a finely controlled amount ΔY. Since the opposite end of the carrier 40 is held at a virtual pivot point, this results in a rotation of the carrier 40 about the Z-axis (yaw axis).

By reference to FIGS. 7 to 9, it will now be explained how the print head unit 10 is fixed at the carrier 40.

Figure 7:
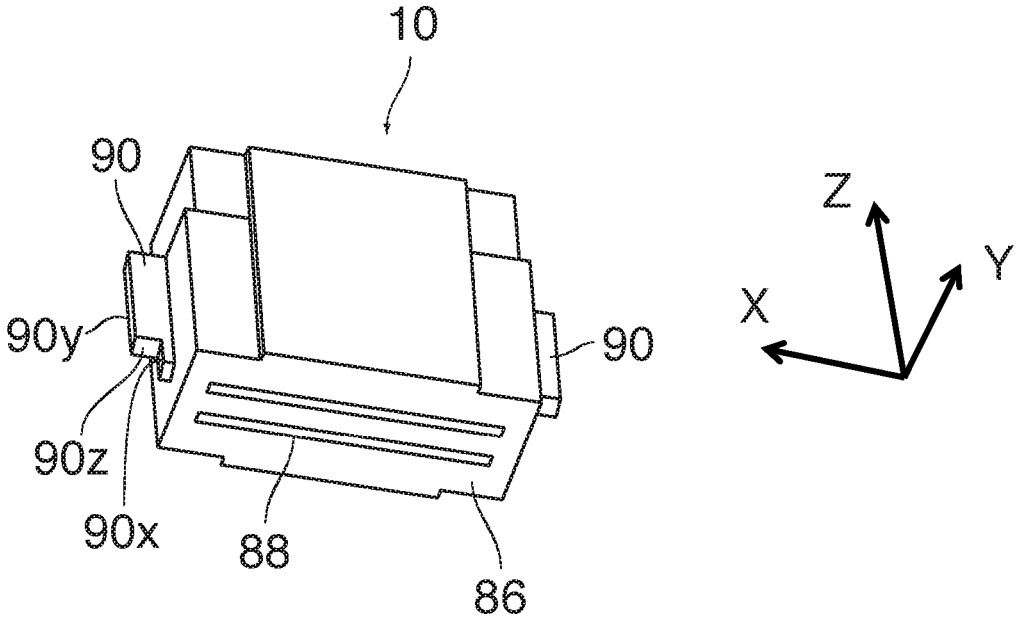
FIG. 7 is a perspective view of an individual print head unit.

FIG. 7 is a perspective view of the print head unit 10 having a nozzle face 86 with two linear nozzle arrays 88 formed therein. As mentioned before, the nozzle face 86 is accommodated in one of the cut-outs 16 of the frame 12 (FIG. 1), and the nozzle arrays 88 extend in X-direction. The body of the print head unit 10 has two laterally projecting reference plates 90 each of which defines three mutually orthogonal reference surfaces 90*x*, 90*y* (on the back side of the plate 90) and 90*z* that have well defined and exactly known positions in X-, Y- and Z-direction, respectively, relative to the nozzle arrays 88.

Figure 8:
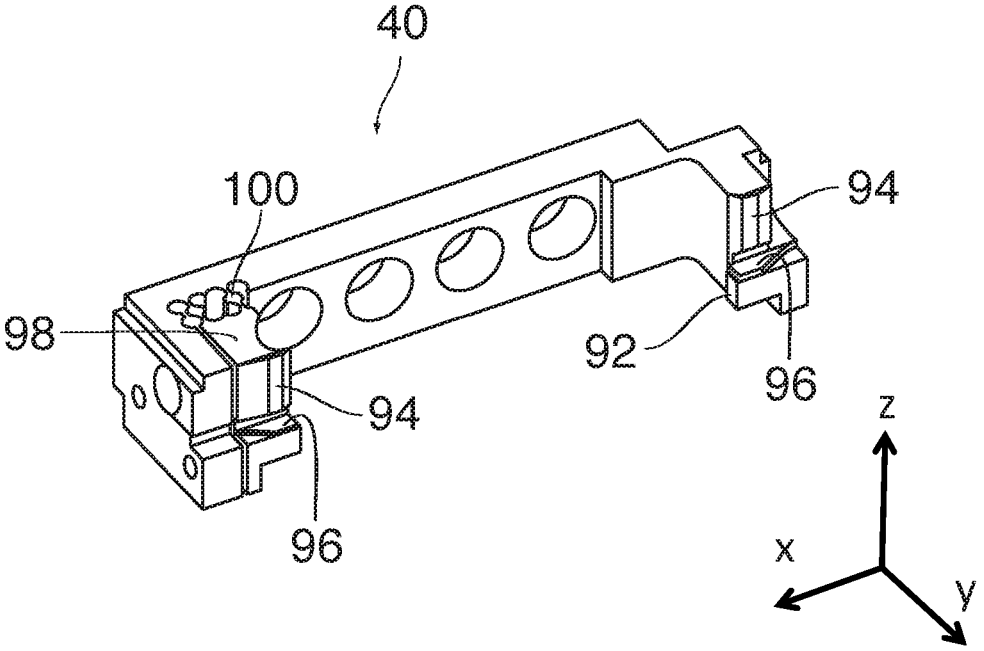
FIG. 8 is a perspective view of a carrier for the print head unit shown in FIG. 7.

FIG. 8 is a perspective view of the carrier 40. The right end of the carrier has a plateau that projects in positive X-direction and defines an X-reference surface 92. Further, each end of the carrier 40 has a plateau that projects forwardly in Y-direction and defines a P-reference surface 94, and an upwardly projecting plateau that defines a Z-reference surface 96. The reference surfaces at the left end of the carrier 40 are formed on a compensation block 98 that is connected to the main body of the carrier 40 via a parallelogram linkage 100. This parallelogram linkage permits to compensate for any possible differential thermal expansion of the carrier 40 and the print head unit 10, while keeping the Y-reference surface 94 parallel to the X-Z-plane and the Z-reference surface 96 parallel to the X-Y-plane.

When the print head unit 10 is to be mounted in the bracket-like carrier 40 which is itself held by the adjusting mechanisms 30, 32 and the holder 34, the print head unit 10 is set against the carrier 40 such that its reference surfaces 90*y* engage the Y-reference surfaces 94 and the reference surface 90*x* (which is not visible on the right side in FIG. 7) engages the X-reference surface 92. Then, the print head unit 10 is moved downward until the reference surfaces 90*z* engage the Z-reference surfaces 96.

Figure 9:
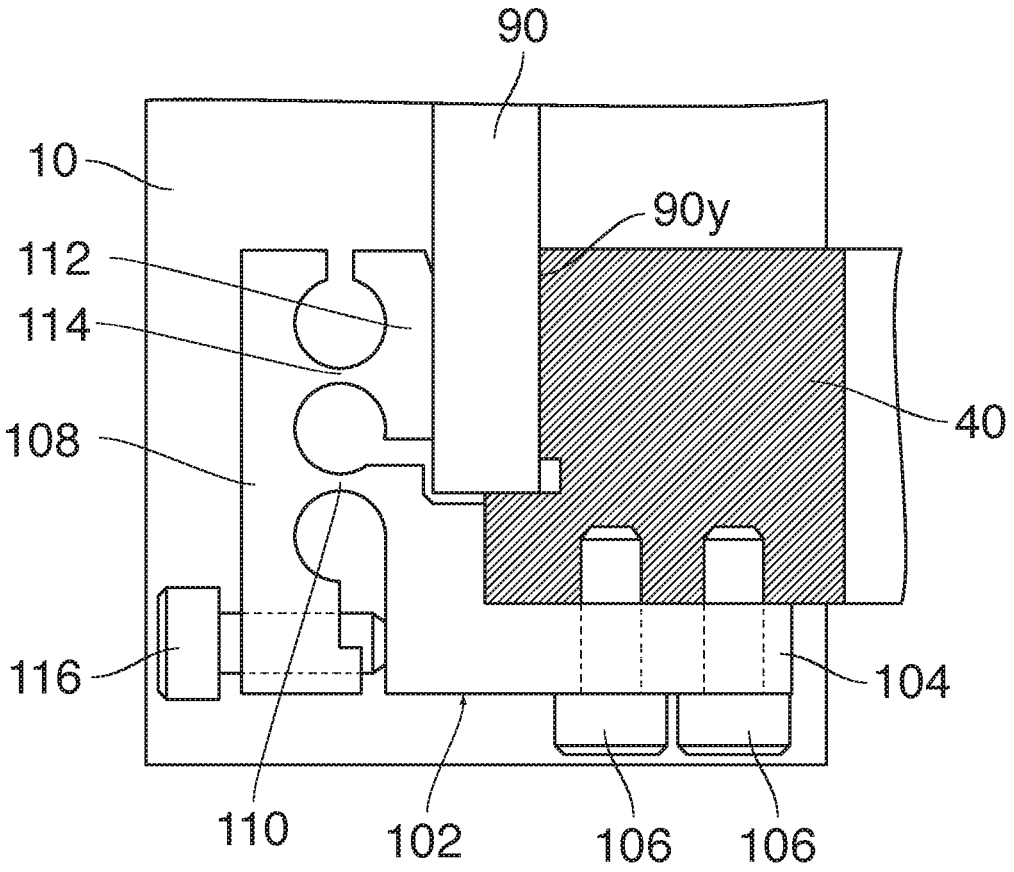
FIG. 9 is a cross-sectional view of the carrier and further shows a part of the print head unit as well as a clamp used for fixing the print head unit at the carrier.

Then, two clamps 102 are used for clamping the reference plates 90 firmly against the Y-reference surfaces 94, as shown in FIG. 9.

The clamp 102 has a base 104 that is attached to the bottom side of the carrier 40 with bolts 106. Further, the clamp 102 has a lever 108 the central portion of which is connected to the base 104 by a flexible hinge 110, and a pressing member 112 connected to one arm of the lever 108 by another flexible hinge 114. A clamping screw 116 is in thread-engagement with a threaded bore of the other arm of the lever 108 and presses against a side face of the base 104. When the clamping screw 116 is tightened, the lever 108 tilts about the flexible hinge 110, and the pressing member 112 is pressed against the reference plate 90 while the hinge 114 permits the pressing member to remain parallel with the reference plate. In this way, the print head unit 10 can be firmly secured at the carrier 40 in a precisely defined position.

When the mounting structure that has been described above is to be assembled, the sub-assemblies constituted by the carriers 40, the adjustment mechanisms 30, 32 and the holders 34 of all the mounting sites 28 are mounted in a common jig. The jig may be a member that comprises dummies of the precisely aligned print head units 10 and may for example be attached to the carriers 40 in the various sub-assemblies by means of the clamps 102 in the same way as has been described for the print head units 10 themselves. Then, the bases 62 of the adjusting mechanisms 32 will be clamped directly to the support 14, and the adjustment mechanisms 30 and the holders 34 are attached to the tabs 36 by means of the clamps 38. Then, when the jig is removed, the sub-assemblies for all the mounting sites 28 will be held at the support 14 in aligned positions in all six degrees of freedom with an accuracy, that is sufficient for at least four of these degrees of freedom, i.e. the Z-positions of both end of the carriers, the Y-positions of the respective right ends of the carriers, rotations about the X-axis and rotations about the Y-axis. The two remaining degrees of freedom (Y-position of the left ends and X-position of all carriers) are pre-set with the same accuracy but may be adjusted even more precisely by means of the adjusting mechanisms 30, 32 individually for each print head unit.

Once the individual print head units 10 have been inserted and fastened by means of the clamps 102, a fine adjustment may for example be performed as follows.

A test print is made by firing the nozzles of all print head units 10 on both sides of the support 14, with the timings of the print head units on the front side and the back side of the support being synchronized with the movement of the recording medium such that continuous straight pixel lines are printed onto the recording medium. Then, the positions of the printed dots are measured in order to determine the correction parameters for the fine adjustment.

For example, when it is found that the distance between a dot at one end of a row that has been printed with a nozzle array 88 a first print head unit 10 and the adjacent dot printed with the nozzle array 88 of the neighbouring print head unit 10 (on the other side of the support) deviates from a nominal distance, then the X-position of the neighbouring print head unit 10 may be corrected by means of the adjusting mechanism 30. In order to correct the X-positions of all print head units 10, the first unit on the front side of the support, at one end of the two rows (see rows of cut-outs 16 in FIG. 1), may be taken as a reference. Then, the next print head unit 10 on the back side of the support will be adjusted. Subsequently, the second print head unit 10 on the front side will be adjusted, the second print head unit on the back side, and so on.

Further, when it is found that the nozzle arrays 88 deviate from their target positions in Y-direction, one may first attempt to minimize these deviations by correcting the timings at which the nozzles of the different print head units are fired. However, when the nozzle arrays 88 are not exactly parallel, the deviations cannot be eliminated completely simply by correcting the timings. In this case, it will however be possible to use the adjusting mechanisms 30 for a yaw adjustment of the print head units until the Y-positions of the last dot printed with one print head unit 10 and the first dot printed with the next print head unit coincide, so that a smooth row of dots is obtained.

Similar fine adjustments may be made when one of the print head units 10 has been replaced by new one and it turns out that a misalignment has occurred due to manufacturing tolerances of the new print head unit.

The invention claimed is:

1. A mounting structure for a plurality of print head units, comprising:

a frame;

a plurality of carriers for carrying individual print head units;

a common support for supporting the plurality of carriers, detachably mounted on the frame;

a plurality of holders for holding individual carriers, detachably mountable to said common support and the plurality of holders providing a corresponding plurality of mounting sites each of which is adapted to hold an individual carrier; and an adjusting system for positional adjustment of the carriers relative to the common support, wherein each mounting site has at least one adjusting mechanism for individually adjusting, in at least one degree of freedom, a position of the carrier that is held in that mounting site.

2. The mounting structure according to claim 1, wherein each carrier is adapted to detachably mount a print head unit.

3. The mounting structure according to claim 1, wherein the frame is a plate-like frame provided with a plurality of cut-outs adapted to accommodate a downwardly facing nozzle face of one of the print head units.

4. The mounting structure according to claim 3, wherein the common support is a plate and is arranged in a plane normal to a plane of the plate-like frame.

5. The mounting structure according to claim 4, wherein the frame has two rows of cut-outs, wherein the mounting sites are disposed in two rows, and wherein the common support has one row of mounting sites on its front side and another row of mounting sites on its back side.

6. The mounting structure according to claim 5, wherein the cut-outs in the two rows of cut-outs are staggered such that the cut-outs of one row fill gaps between the cut-outs of the other row, and wherein the mounting sites in the two rows of mounting sites are staggered such that print head units held in one row fill the gaps between print head units held in the other row.

7. The mounting structure according to claim 1, wherein the frame and the common support are provided with mating positioning and mounting elements for detachably mounting the support on the frame, the positioning and mounting elements permitting a certain play in the plane of the frame to allow for thermal expansion of the common support relative to the frame.

8. The mounting structure according to claim 7, wherein the mating positioning and mounting elements comprise three spherical positioning bulges and three recesses for receiving said bulges.

9. The mounting structure according to claim 8, wherein the three recesses comprise a support patch and a V-shaped positioning groove.

10. The mounting structure according to claim 1, wherein each adjusting mechanism comprises a plate which has at least one link arranged to transmit a force onto a part of the carrier in a direction of adjustment but being flexible in at least one other direction normal to said direction of adjustment, and wherein the plate has a lever that is pivotable about a pivot point and is connected to one end of said link through a thinned part of the plate.

11. The mounting structure according to claim 10, wherein said pivot point is defined by two non-parallel hinged links that connect said lever to a fixed part of the plate.

12. The mounting structure according to claim 1, wherein each carrier is held between an adjusting mechanism and the holder, said holder comprising a plate having at least two flexible links that extend in mutually orthogonal directions and define a position of a corresponding part of the carrier in these two directions but are flexible to permit said part of the carrier to follow the adjustment movement performed with any of the adjusting mechanisms for that carrier.

13. The mounting structure according to claim 12, wherein said adjusting mechanisms and said holder are attached to the common support through clamp action.

14. The mounting structure according to claim 13, wherein the common support is an elongated plate with a row of mounting sites formed on at least one side of the plate, and one adjusting mechanism and said holder of each mounting site are clamped to tabs that project at right angles from the support.

15. A print head assembly, the print head assembly comprising a mounting structure according to claim 1 and a row of print head units held in the respective mounting sites, wherein each mounting site has an adjusting mechanism for adjusting the position of a print head unit in the direction of the row of print head units.

16. A print head assembly, the print head assembly comprising a mounting structure according to claim 1 and at least one print head unit held in a respective mounting site, wherein each print head unit has a face in which at least one array of printing elements is formed, and wherein each mounting site has an adjusting mechanism adapted to rotate the print head unit about an axis that is normal to said face.

* * * * *